US006630755B2

(12) United States Patent
Petriello

(10) Patent No.: US 6,630,755 B2
(45) Date of Patent: Oct. 7, 2003

(54) GUARDIAN PERSONNEL PROTECTION SYSTEM

(75) Inventor: James T. Petriello, 299 Christian Herald Rd., Valley Cottage, NY (US) 10989

(73) Assignee: James T. Petriello, Nyack, NY (US)

( * ) Notice: Subject to any disclaimer, the term of this patent is extended or adjusted under 35 U.S.C. 154(b) by 0 days.

(21) Appl. No.: 09/991,004

(22) Filed: Nov. 16, 2001

(65) Prior Publication Data

US 2003/0094859 A1 May 22, 2003

(51) Int. Cl.[7] ..... F05F 15/02
(52) U.S. Cl. ..... 307/326; 307/112; 307/119
(58) Field of Search ..... 307/326, 119, 307/112; 160/118

(56) References Cited

U.S. PATENT DOCUMENTS 5,821,644 A * 10/1998 Sommer ..... 307/326

* cited by examiner

*Primary Examiner*—Brian Sircus
*Assistant Examiner*—Robert L. DeBeradinis

(57) ABSTRACT

Electrically operated folding operable walls controlled by an electrical operation circuit of the type having a key switch, a control panel, an extend limit, a stack limit, control relays and a motor. The invention consists of a mechanism designed to provide safety during the operation of said folding walls by sensing a person or object with a lead edge sensor, floor mat sensors, and a wireless transmitter and receiver assembly that, when wired to the folding wall control panel, will shut down the operation of the folding wall. Another mechanism provides for the restarting of the folding wall by resetting the relay inside the control panel.

1 Claim, 2 Drawing Sheets

Top View

Side View

GUARDIAN PERSONNEL PROTECTION SYSTEM

CROSS-REFERENCE TO RELATED APPLICATIONS

"Not applicable"

FEDERALLY SPONSORED RESEARCH & DEVELOPMENT

"Not applicable"

SEQUENCE LISTING

"Not applicable"

BACKGROUND OF THE INVENTION

Field of the invention: the invention relates generally to electrically operated folding walls and more specifically to electrically operated gymnasium partitions.

SUMMARY OF THE INVENTION

A first object of the invention is to enable electrically operated folding walls to overcome the obvious safety shortcomings of prior devices.

A second object is to provide electrically operated folding walls that will include a safety device that will respond to contact with a person or object and immediately shut down the electrical control circuit, disabling the operable folding wall.

A third object is to provide said safety device without the need for cumbersome and often unreliable wiring, which must bend one hundred and eighty degrees each time the folding wall is operated due to the fact that it must be physically attached to the top of the folding wall.

A fourth object is to provide an operable folding wall that is safe to operate at any given time.

A fifth object is to provide a safety system that is reliable, simple and easy to operate.

A sixth object is to provide a safety system that is on and armed as long as the folding wall electrical supply circuit is energized.

Item 1 is the folding wall's track that the wall rides on.

Item 2 is the first or lead panel.

Item 3 is the drive motor assembly.

Item 4 is the electrical control box, containing the folding wall's electrical relays.

Item 5 is the receiver unit from the invention, which is connected to the electrical controls of the folding wall.

Item 6 is the transmitter unit of the invention, which is connected to the lead edge sensor.

Item 7 is the lead edge sensor.

Item 8 has been omitted from this view for clarity.

Item 9 is the building wall.

Item 10 is the floor mat(s) positioned under the folding wall.

Item 11 has been omitted from this view for clarity.

Item 12 is a reset button.

Figure 1:
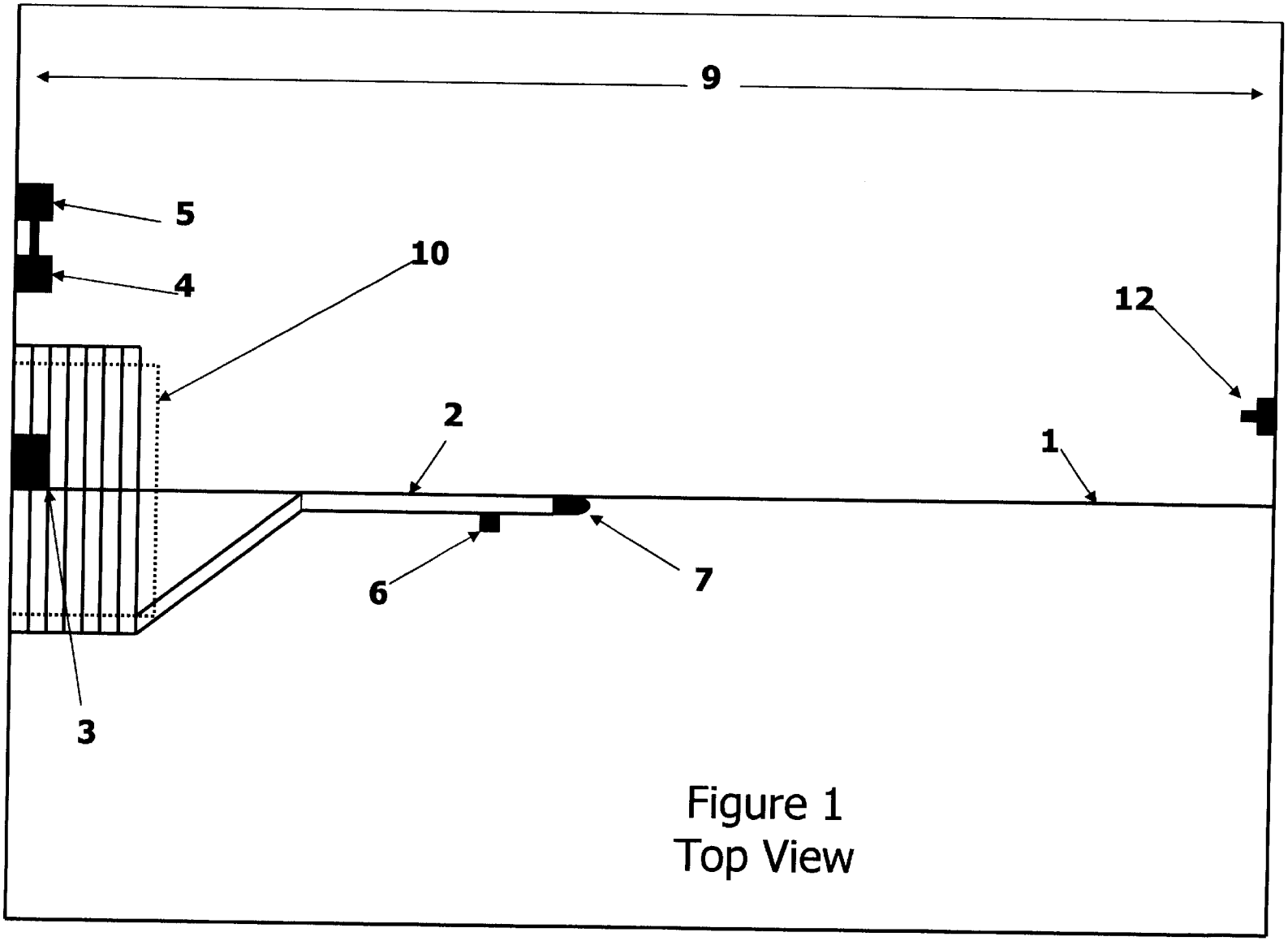
FIG. 1 is a top view of a typical electric folding wall.
Figure 2:
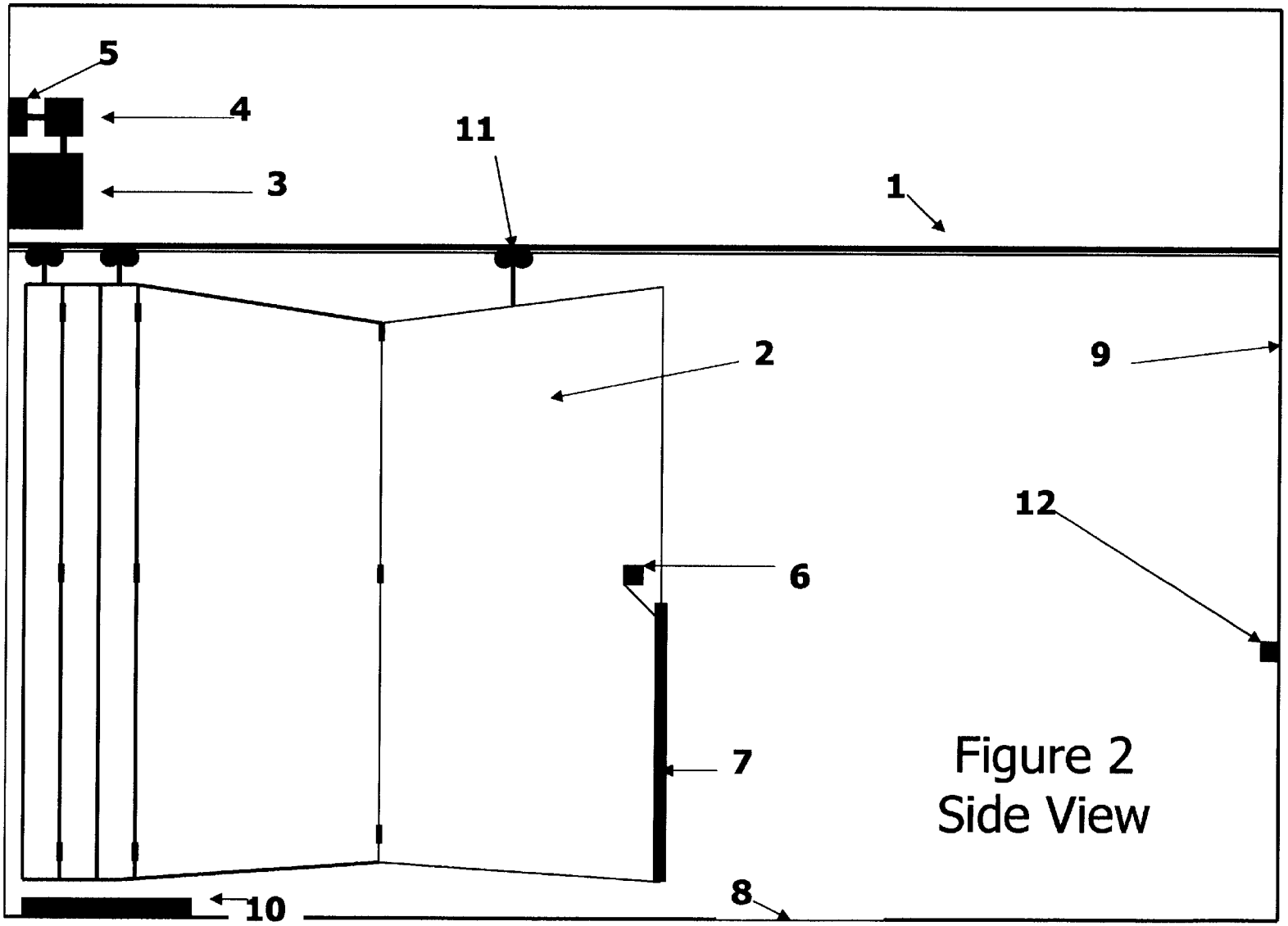

FIG. 2 is a side view of a typical electric folding wall.

Item 1 is the folding wall track.

Item 2 is the lead panel.

Item 3 is the drive motor assembly.

Item 4 is the electrical control box of the folding wall.

Item 5 is the receiver unit of the invention.

Item 6 is the transmitter unit of the invention.

Item 7 is the lead edge sensor.

Item 8 is the floor of the building.

Item 9 is the wall of the building.

Item 10 is the floor mat(s) positioned under the folding wall.

Item 11 is the folding wall trolley that rides along the folding wall track.

Item 12 is a reset button.

DETAILED DESCRIPTION OF THE INVENTION

Electrically operated folding walls are inherently dangerous simply because of the large amount of force needed to move their immense weight. If pinned by a folding wall, a person can be severely injured or killed by its crushing force. Using the drawings as a guide, the description is as follows: The lead edge sensor (7) acts as a bumper, mounted on the leading edge (2) of the folding wall. When the lead edge sensor (7) comes in contact with a person or object, due to the folding wall moving in a forward motion, the switch inside closes, completing a circuit inside the transmitter (6), which then transmits a radio frequency signal to the receiver (5). The receiver (5) then sends a signal via hard wires to the electrical control box (4), which in turn opens the common circuit of the electrical control circuit, which immediately halts the operation of the folding wall by shutting off power the drive motor assembly (3). The major advantage of the transmitter (6) and receiver (5) being wireless is the elimination of cumbersome and unreliable wiring that would have to be strung along the top of the folding wall. It is this wiring that is prone to fraying and other damage due to the fact that it must bend one hundred and eighty degrees each time the folding wall is operated.

Furthermore, the floor mats (10) operate in much the same way as the lead edge sensor (7). That is to say, while the folding wall is traveling in a reverse direction, a person may attempt to travel behind it to get to the opposite side of the room. In their attempt to do so, they would be required to step on the floor mat (10). The force of the weight of the person would then close the switch inside the mat and complete a circuit inside the electrical control box (4), which would open the common circuit of the electrical control circuit and halt the operation of the folding wall as described above.

Once the operation has been halted, the operator may reset the safety device by pushing a reset button (12) allowing the power to be restored to the drive motor assembly.

While certain features of this invention have been shown and described and are pointed out in the claims, it is not intended to be limited to the details above, since it will be understood that various omissions, modifications, substitutions, and changes in the forms and details of the device illustrated and in its operation can be made by those skilled in the art without changing in any way the spirit of the invention.

What I claim is new and desired to be protected by patent is set forth in the appended claims:

1. Electrically operated folding operable walls controlled by an electrical operation circuit of the type having a key switch, a control panel, an extend limit switch, a stack limit switch, control relays and a motor, in which the invention being a safety system comprises:

a) Means for providing a lead end sensing edge mounted on the leading edge of the lead (first) panel using an aluminum or PVC mounting channel, mounted in a vertical configuration from the bottom of the panel to six feet in height placing the sensor in the best possible location to allow it to strike an object or person while the motorized operable wall is in a forward motion thereby applying pressure to the lead edge sensor;

b) Means for providing one or two floor mats, placed under the partition, in the stack area to allow an object placed on or a person stepping on said mats thereby applying pressure, to activate the internal strip switch while the motorized operable wall is in a reverse motion;

c) Means for transmitting a radio frequency (RF) signal from either the lead end sensing edge or the floor mats to a remote receiver, when either the lead sensing edge has made contact with a person or object or a person has stepped on, or an object has been placed on the floor mats;

d) Means for shutting down the electrical operation circuit of said folding operable walls when a person or object comes in contact with the lead sensing edge, or a person steps on, or an object is placed on the floor mats, said shutting down means includes a control unit electrically connected between the control panel of the electrical operation circuit and the RF receiver, which will turn off the electrical operation-circuit upon receiving an RF signal from either RF transmitter located at the aforementioned lead sensing edge or floor mats;

e) Means for restarting the electrical operation circuit of said folding operable walls after the person or object has been removed from the path of the folding operable wall; said restarting means includes a reset control switch, either button or key operated, mounted on the wall in proximity to the operable folding wall's original operating switch which, when activated, will reactivate the electrical operation circuit allowing the folding operable wall to be operated again.

* * * * *